US009460841B2

(12) United States Patent
Fontana et al.

(10) Patent No.: US 9,460,841 B2
(45) Date of Patent: Oct. 4, 2016

(54) INTEGRATED INDUCTOR DEVICE WITH HIGH INDUCTANCE IN A RADIOFREQUENCY IDENTIFICATION SYSTEM

(75) Inventors: Fulvio Vittorio Fontana, Monza (IT); Giovanni Graziosi, Vimercate (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 14 days.

(21) Appl. No.: 13/437,843

(22) Filed: Apr. 2, 2012

(65) Prior Publication Data

US 2012/0249276 A1 Oct. 4, 2012

(30) Foreign Application Priority Data

Apr. 1, 2011 (IT) ..... TO2011A0295

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 17/00*** | (2006.01) |

(52) U.S. Cl.
CPC ..... *H01F 17/0013* (2013.01)

(58) Field of Classification Search
CPC ..... H01F 17/0013; H01F 17/0006
USPC ..... 336/200, 232, 234, 170, 222, 180, 105, 336/84 R, 84 C
See application file for complete search history.

(56) References Cited

U.S. PATENT DOCUMENTS

| | | | | |
|---|---|---|---|---|
| 2,911,605 | A * | 11/1959 | Wales, Jr. | 336/200 |
| 4,959,630 | A | 9/1990 | Yerman et al. | |
| 5,047,719 | A | 9/1991 | Johnson et al. | |
| 5,381,124 | A | 1/1995 | Roshen | |
| 5,532,667 | A * | 7/1996 | Haertling | H01L 23/055 257/E23.19 |
| 6,023,114 | A * | 2/2000 | Mori et al. | 310/90 |
| 6,628,531 | B2 * | 9/2003 | Dadafshar | 361/836 |
| 6,716,672 | B2 * | 4/2004 | Val | 438/109 |

(Continued)

FOREIGN PATENT DOCUMENTS

| | | |
|---|---|---|
| DE | 102007019111 | 10/2008 |
| EP | 0035964 | 9/1981 |

(Continued)

OTHER PUBLICATIONS

Search Report for Italian Application No. TO20110295, Ministero dello Sviluppo Economico, Munich, Nov. 22, 2011, pp. 2.

(Continued)

*Primary Examiner* — Elvin G Enad
*Assistant Examiner* — Kazi Hossain
(74) *Attorney, Agent, or Firm* — Seed IP Law Group PLLC

(57) ABSTRACT

An embodiment of integrated inductor device, comprising a plurality of modules overlaid to each other, each module including at least one coil of conducting material. The directly overlaid pairs of coils are coiled in opposite directions. The directly overlaid modules are mechanically coupled through first adhesive conductive regions and the coils of the directly overlaid modules are electrically coupled to each other through second adhesive conductive regions. The first and the second adhesive conductive regions coupling directly overlaid modules are formed in the same step of the process, are of the same material and are arranged at a same level.

16 Claims, 10 Drawing Sheets

(56) References Cited

U.S. PATENT DOCUMENTS

| | | | | |
|---|---|---|---|---|
| 7,369,028 | B2 * | 5/2008 | Matsunaga et al. | 336/200 |
| 7,663,225 | B2 * | 2/2010 | Kudo et al. | 257/700 |
| 7,859,382 | B2 * | 12/2010 | Koprivnak et al. | 336/200 |
| 8,390,417 | B2 * | 3/2013 | Ueno | 336/200 |
| 8,441,333 | B2 * | 5/2013 | Chiu et al. | 336/200 |
| 2004/0075525 | A1 | 4/2004 | Sippola et al. | |
| 2006/0115931 | A1 * | 6/2006 | Hsu | H01L 24/24 438/121 |
| 2006/0158301 | A1 * | 7/2006 | Shinkai et al. | 336/232 |
| 2007/0030659 | A1 * | 2/2007 | Suzuki et al. | 361/793 |
| 2007/0057755 | A1 * | 3/2007 | Suzuki et al. | 336/200 |
| 2008/0238600 | A1 | 10/2008 | Olson | |
| 2008/0257488 | A1 * | 10/2008 | Yamano | 156/272.4 |
| 2008/0290528 | A1 * | 11/2008 | Hsu | H01L 23/49816 257/779 |
| 2010/0109123 | A1 * | 5/2010 | Strzalkowski et al. | 257/531 |
| 2010/0157565 | A1 * | 6/2010 | Yoshida et al. | 361/811 |
| 2010/0289610 | A1 * | 11/2010 | Jacobson et al. | 336/84 C |
| 2011/0074535 | A1 * | 3/2011 | Banno | 336/192 |
| 2011/0227688 | A1 * | 9/2011 | Park et al. | 336/200 |

FOREIGN PATENT DOCUMENTS

| | | |
|---|---|---|
| EP | 1304707 | 4/2003 |
| EP | 2109120 | 10/2009 |
| JP | 4-206906 | 7/1992 |
| JP | 6-251945 | 9/1994 |
| JP | 11-016729 | 1/1999 |
| JP | 2005-222997 | 8/2005 |
| WO | 9903117 | 1/1999 |

OTHER PUBLICATIONS

Search Report for Italian Application No. TO20110296, Ministero dello Sviluppo Economico, Munich, Jan. 24, 2012, pp. 3.

* cited by examiner 11
25
31
30
26A
28
32
28
33
27A 13
25
31
30
32
27B
33
26B 17
25
31
30
32
26C
33
27C 19
39
37
31
30
28
32
36
33
27D
35
39
26D

INTEGRATED INDUCTOR DEVICE WITH HIGH INDUCTANCE IN A RADIOFREQUENCY IDENTIFICATION SYSTEM

PRIORITY CLAIM

The instant application claims priority to Italian Patent Application No. TO2011A000295, filed Apr. 1, 2011, which application is incorporated herein by reference in its entirety.

TECHNICAL FIELD

An embodiment relates to an integrated inductor device with high inductance, for example for use as an antenna in a radiofrequency identification system.

BACKGROUND

The medical field sees an increasingly widespread use of devices based on MEMS resonators that can withstand difficult conditions and operate as radio frequency identification (RFID) memories, in which the resonators are activated by the magnetic field generated by the current flowing in an antenna.

For this purpose, the antenna should meet some requirements, such as having an inductance value on the order of microHenries (μH), a small size, and a low cost. It has already been suggested to make the antenna on a BGA/LGA (Ball Grid Array/Land Grid Array) substrate. These substrates are formed by a plurality of overlaid conductive tracks (generally of copper, each formed in a conductive layer), and insulated from each other by insulating material layers. Holes, referred to as "vias", allow electric contact through different insulating layers of the substrate. The electric contact in the holes is obtained by the metallization of the inner surface of the holes, obtained by a process of electrochemical plating or by applying a conductive material layer and by screening and a subsequent high temperature baking. Another method to produce the electric contact through the holes consists in totally filling the latter with an adhesive charged with conductive particles by screening and baking, or by injection and baking and baking the conductive adhesive. The holes mutually couple the conductive tracks so as to form a plurality of conductive paths. In this case, the antenna for the memories or other RFID device may be produced on one of the main surfaces of the BGA/LGA substrate, for example as a miniaturized loop antenna, formed by a track of copper or other conducting material.

This implementation, however, allows achieving only low values of inductance (a few nanoHenries), while, as indicated above, the application as an antenna for a RFID system may require values of about three orders of magnitude higher.

SUMMARY

An embodiment is an integrated inductor device that overcomes the drawbacks of the prior art.

In an embodiment, an inductor device is formed by superimposing a plurality of substrates or modules having the same structure.

Furthermore, in an embodiment, for each substrate or module, each coil is associated to at least one first adhesive conductive region that achieves the mechanical connection with an adjacent substrate (module) and to at least one second adhesive conductive region that achieves the electric connection with the coil formed in the adjacent substrate (module) and the first and second adhesive conductive regions are made of the same material and are arranged at a same level.

In an embodiment, each module is made as a BGA/LGA substrate, including at most four metallization levels. In particular, by superimposing six modules of four metallization layers each, an overall inductance on the order of one μH can be obtained with a simple layout and a reduced area (for example, about 3.6 $mm^2$). Adhesive conductive regions formed by conductive glue or solder paste formed on the mutually facing surfaces of the overlaid modules allow mechanical and electric coupling among the various modules, in a simple and effective manner.

As an alternative, each module is formed by a substrate carrying a coil made by applying conductive material. The same conductive layer forming the coil also forms electric contact regions and mechanical connection regions. After stacking a plurality of modules, the latter are glued by using the mechanical connection regions.

The stacking can occur at a board level, each board integrating a plurality of identical modules and the single devices being obtained by cutting overlaid boards, or at a single-module level, by gluing to a first board single devices formed in a second board, which has been previously cut, and then also cutting the first board.

BRIEF DESCRIPTION OF THE DRAWINGS

For a better understanding of the present disclosure, one or more embodiments thereof will now be disclosed as a non-limitative example only and with reference to the accompanying drawings, wherein.

DETAILED DESCRIPTION

Figure 1:
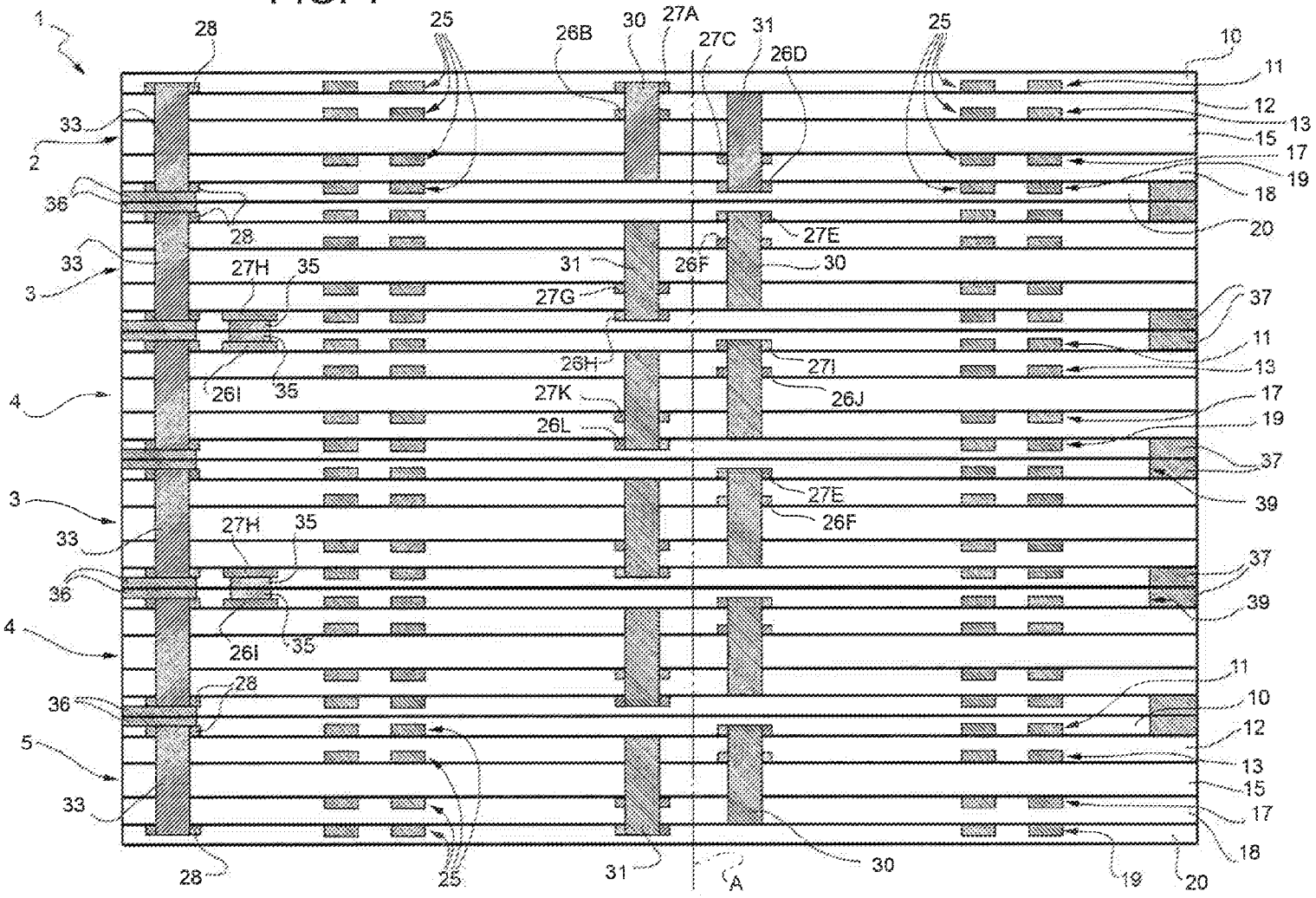
FIG. 1 is a cross-section of an embodiment of the present integrated inductor.
Figure 2:
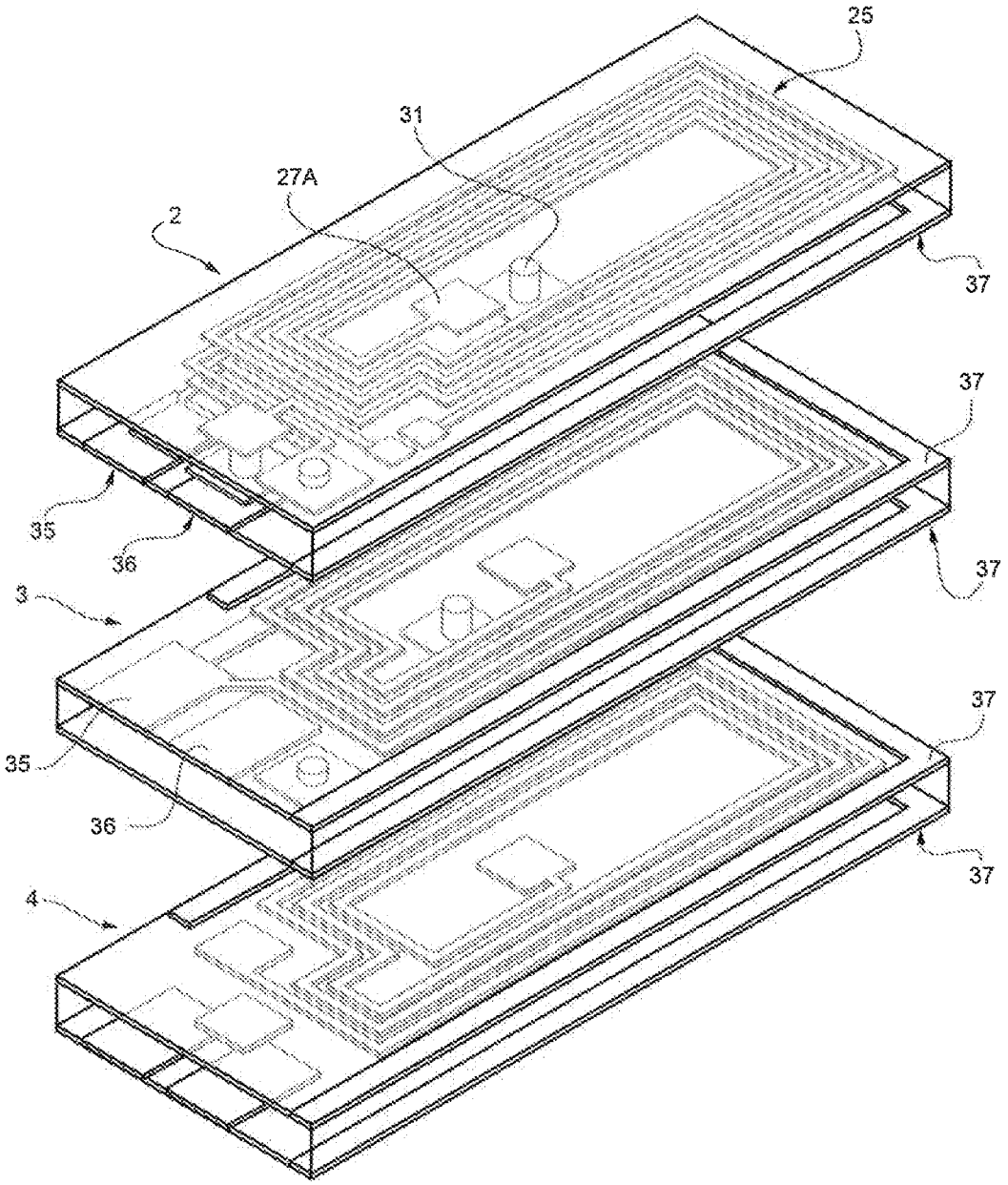
FIG. 2 is an exploded perspective view of a part of the integrated inductor of FIG. 1.

FIG. 1 shows a first embodiment of an integrated inductor 1 formed by a plurality of overlaid modules 2-5 having a similar structure, each incorporating four coils 25 which are overlaid so as to have the center aligned along a single central axis A and to be mutually coupled. The directly overlaid coils are wound in opposite directions so that the current always flows in a single direction (clockwise or counterclockwise).

Hereinafter, for the sake of clarity, the current is assumed to flow counterclockwise in all coils and the connections are accordingly defined as "input" and "output" connections. But the direction of the current could be opposite, therefore reversing the role of the connections.

The plurality of modules 2-5 includes in this case six modules, including a first end module, typically an upper module 2, a second end module, typically a bottom module 5, two first intermediate modules 3 and two second intermediate modules 4, the first and the second intermediate modules 3, 4 being alternated. Modules 2-5 are manufactured according to the BGA technique, each having four metal layers, one for each coil, and differ only slightly in the layout.

In detail, each of the modules 2-5 is formed by a first insulating layer 10, a first metal layer 11, a second insulating layer 12, a second metal layer 13, a core layer 15, a third metal layer 17, a third insulating layer 18, a fourth metal layer 19, and a fourth insulating layer 20.

The first and the fourth insulating layer 10, 20 respectively forming the upper layer and the bottom layer of each module 2-5, are typically made as solder masks, i.e. of a non-conductive material that may be shaped by screening, for example of polymer material, such as, among others, AUS 308 material of Taiyo America, Inc.

The second and the third insulating layers 12 and 18 are so-called "prepreg" layers i.e. each formed by, for example, a BT laminate containing crossed glass fibres therein, which ensure rigidity and a reduced temperature expansion.

Core layer 15 is of an insulating material, typically plastic, for example a BT (Bismaleimide Triazine) or FR-4 or other material of printed circuits.

Figures 3A, 3B, 3C, 3D:
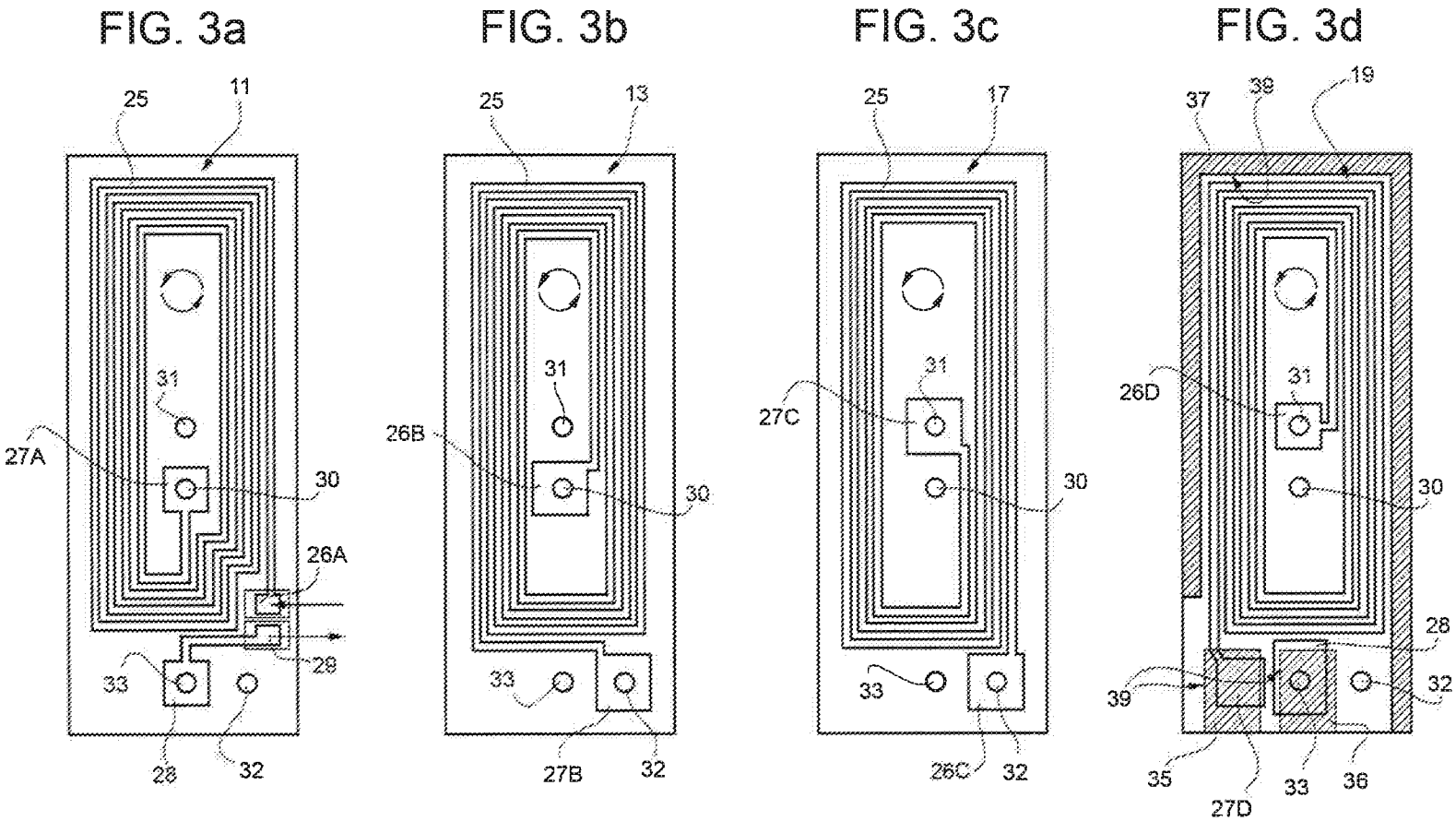
FIGS. 3*a*-3*d* show the layout of the four layers forming an upper module of the integrated inductor of FIG. 1.
Figure 4A:
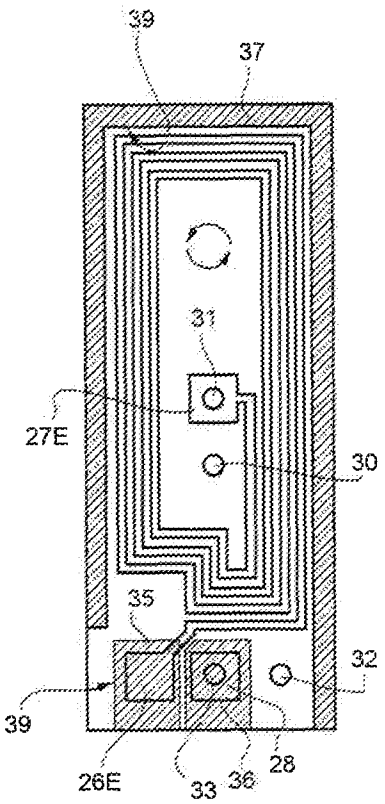
FIGS. 4*a*-4*d* show the layout of the four layers forming a first intermediate module of the integrated inductor of FIG. 1.
Figure 4B:
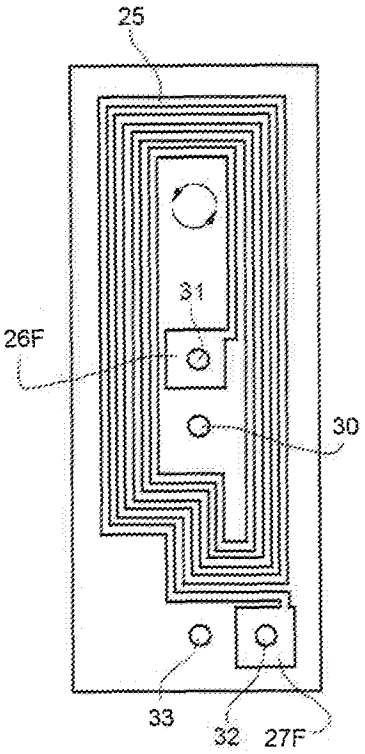
Figure 4C:
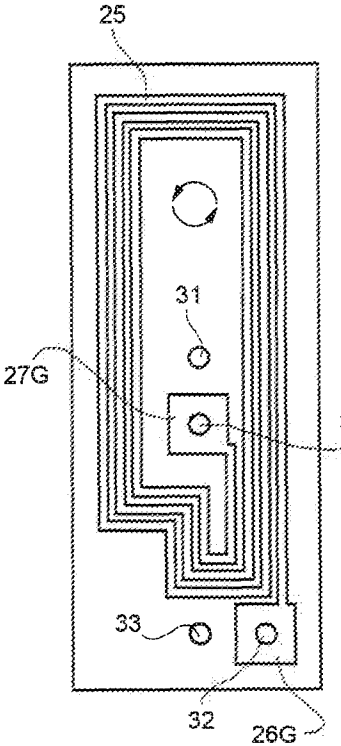
Figure 4D:
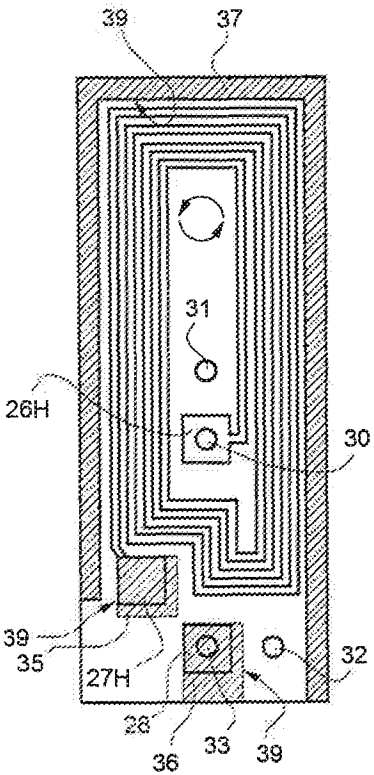
Figure 5A:
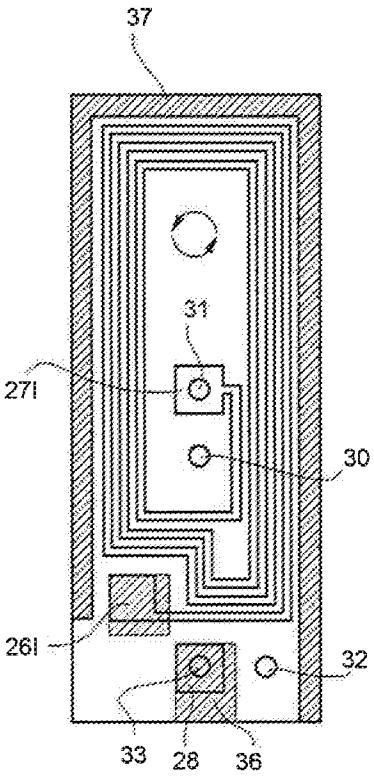
FIGS. 5*a*-5*d* show the layout of the four layers of a second intermediate module of the integrated inductor of FIG. 1.
Figure 5B:
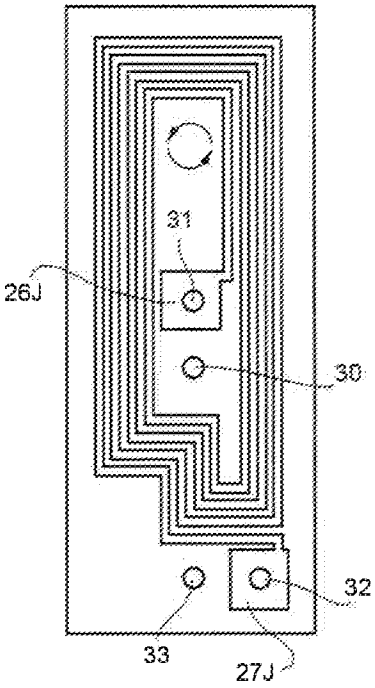
Figure 5C:
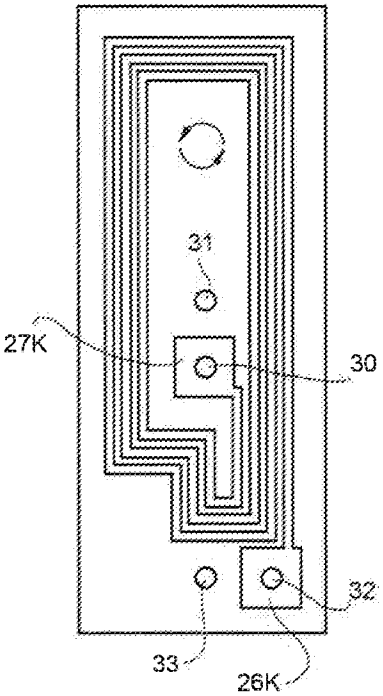
Figure 5D:
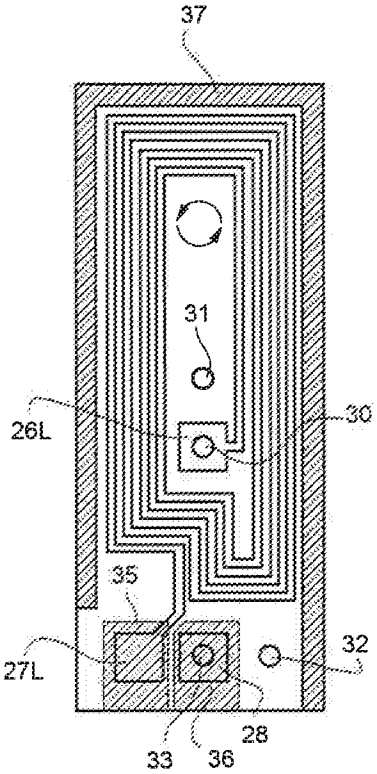
Figure 6A:
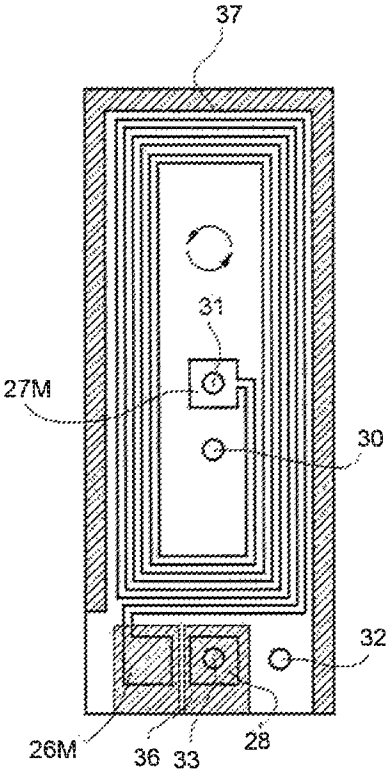
FIGS. 6*a*-6*d* show the layout of the four layers of the bottom module of the integrated inductor of FIG. 1.
Figure 6B:
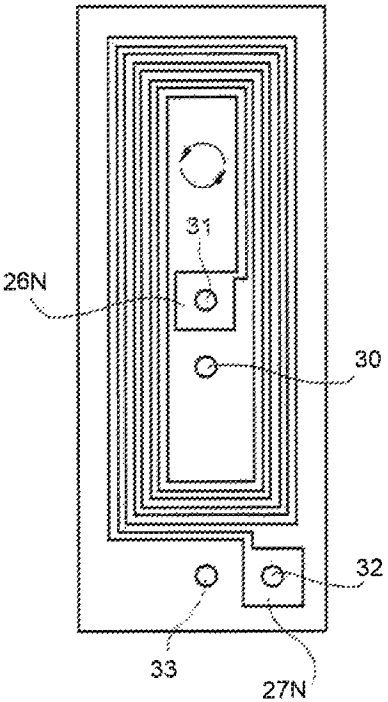
Figure 6C:
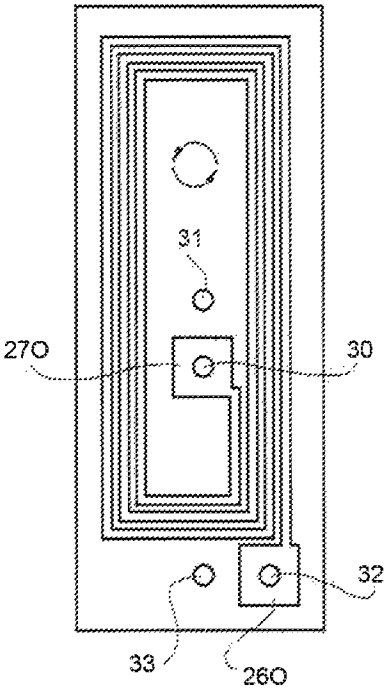
Figure 6D:
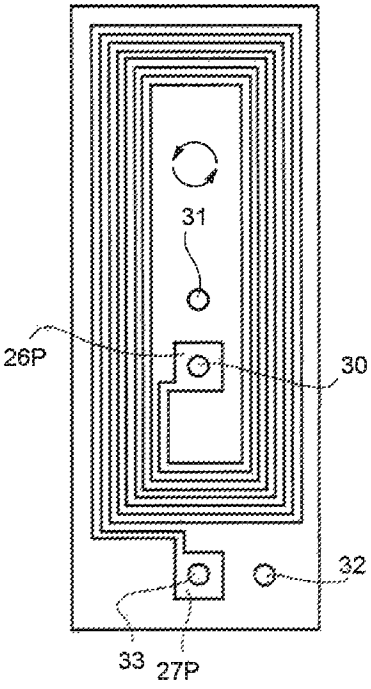

Metal layers 11, 13, 17, 19 are, for example, of copper with an upper, corrosion protecting layer, typically of nickel-gold, and are shaped so as to each form a respective coil 25 as well as pads for the connections, including at least, for each metal layer, an input pad 26 and an output pad 27 (in which the indication "input" and "output" refer to the current direction shown, as explained above, and are not limitative). Furthermore, first and fourth metal layers 11, 19 of all modules 2-4 also each form a connection pad 28 and the first metal layer 11 of upper module 2 forms an output terminal 29 (FIG. 3*a*). The electric connections, together with the conductive vias passing through different modules 2-4, are configured and arranged so as to allow current to flow in coils 25 always in the same direction, as disclosed hereinafter.

Coils 25 of metal layers 11, 13, 17 and 19 are each formed by a spiral, and the spirals of two overlaid layers are wound in opposite directions, but input pads 26A-26P are arranged alternatively near the edge and near the center of the integrated inductor 1. Therefore, coil 25 of first metal layer 11 of all modules 2-5 is wound in a counterclockwise direction from the outside and from its own input pad (input pad 26A, 26E, 26I and 26M, FIGS. 3*a*, 4*a*, 5*a* and 6*a*), coil 25 of second metal layer 13 is wound from the outside in a clockwise direction (corresponding to a counterclockwise direction from its own input pad 26B, 26F, 26J and 26N, FIGS. 3*b*, 4*b*, 5*b* and 6*b*), coil 25 of third metal layer 17 is wound in a counterclockwise direction from the outside and from its own input pad (input pad 26C, 26G, 26K and 26O, FIGS. 3*c*, 4*c*, 5*c* and 6*c*), and coil 25 of fourth metal layer 19 is wound from the outside in a clockwise direction (corresponding to a counterclockwise direction from its own input pad 26D, 26H, 26L and 26P, FIGS. 3*d*, 4*d*, 5*d* and 6*d*).

Output pads 27A-27P of modules 2-4 are arranged vertically aligned to input pads 26B-26P of the metal level immediately below, as may be noted easily from FIGS. 3*a*-5*d*. Accordingly, output pads 27A-27P are also arranged alternatively near the edge or near the center of integrated inductor 1.

Vice versa, connection pads 28 of all the metal layers 2-5 are overlaid. Furthermore, connection pad 28 of fourth metal layer 19 of bottom module 5 also forms an output pad of the bottom module 5.

Conductive vias 30-33 completely pass through each module 2-4, but vias 30-32 each couple reciprocally, in each module, a single output pad with the immediately underlying input pad, whereas vias 33 couple all the connection pads 28 to each other. Here, vias 30, 31 are arranged near the center of integrated inductor 1; vias 32-33 are arranged near the edge. In particular, as may be seen in FIG. 1, in upper module 2, conductive via 30 passes through and electrically couples output pad 27A to input pad 26B (both in a central position); conductive via 31 passes through and electrically couples output pad 27C to input pad 26D. As may be seen in FIGS. 3*b*, 3*c*, via 32 (not visible in FIG. 1 because hidden by via 33) passes through output pad 27B of second metal level 13 of upper module 2 and couples the latter to input pad 26C of underlying metal level 17; similarly, vias 30-32 of modules 5-4 respectively couple the output pads to the directly underlying input pads, as may be seen in FIGS. 4*a*-6*d*.

Output pads 27D, 27H and 27L of fourth metal level 19 of modules 2-4 are instead coupled to input pads 26E, 26I and 26M of an underlying level (first metal level 13 of modules 3-5) by first electric connection regions 35, represented by a shaded line in FIGS. 3*a*-6*d*.

Similarly, vias 33 of modules 2-5 are reciprocally coupled to each other by second electric connection regions 36; mechanical connection regions 37 mechanically couple modules 2-5 to each other. Mechanical connection regions 37 extend peripherally near the edges of relative modules 2-5 on both sides thereof, except for the sides intended to form the upper surface and the lower surface of integrated inductor 1.

First and second electric connection regions 35, 36 and mechanical connection regions 37 form adhesive conductive regions extending, for each upper and lower surface of modules 2-5, horizontally aligned (on a same level) in corresponding openings 39 of the first and fourth insulating layers 10, 20 of modules 2-5, except for, as indicated, mechanical connection regions 37 of the upper and lower surfaces of inductor 1 and are formed by the same material, applied approximately simultaneously, for example, a conductive glue (containing, for example, an Ag filler) or a tin-silver, tin-silver-copper, or other lead-free metal welding alloy.

Integrated inductor 1 is manufactured as follows according to an embodiment.

Figure 7:
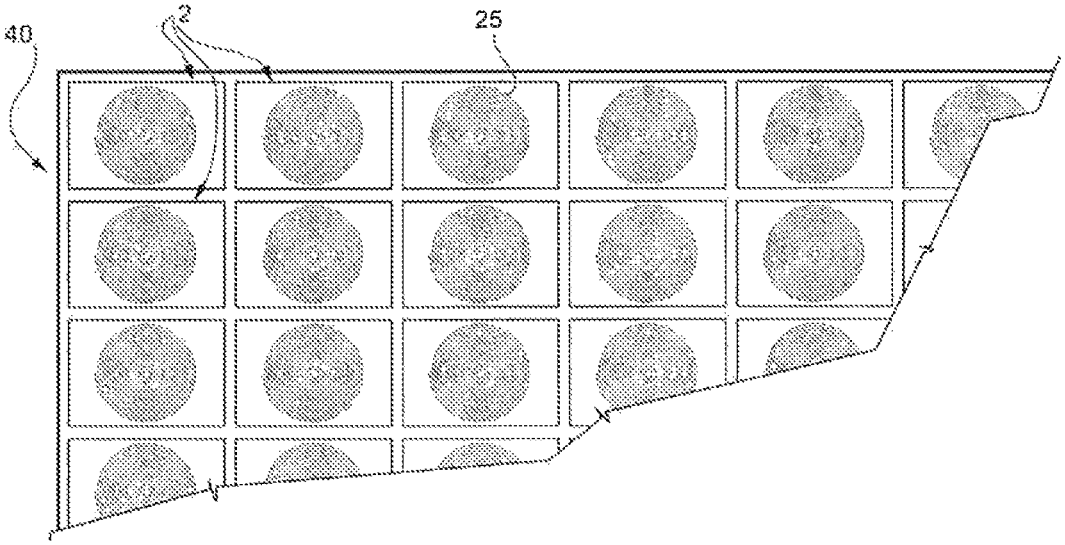
FIG. 7 shows a board integrating a plurality of identical modules for the formation of a plurality of integrated inductors of the type shown in FIG. 1.

First, a plurality of boards 40 is manufactured (FIG. 7 shows a part thereof). Each board is formed by a plurality of approximately identical modules 2, 3, 4, or 5. For example, FIG. 7 shows a plurality of upper modules 2. Boards 40 are manufactured according to known technologies, so that each module 2-5 has the disclosed configuration. Therefore, a conductive adhesive or a lead-free paste is applied by screening or dispensing on the side areas of first and fourth insulating layers 10, 20 and over output pads 27 and vias 33 to form regions 35-37; therefore, boards 40 relative to the various modules are overlaid and reciprocally glued. In particular, if the adhesive conductive vias 35-37 are made by conductive glues, before superimposition, boards 40 are subjected to a thermal treatment at a polymerization-initiation temperature lower than the glass-transition temperature of the glue (depending on the type of glue), in order to obtain a sufficient adhesion of adhesive conductive regions 35-37 and to maintain the overlaid modules in position. Once the boards are overlaid, the polymerization of the adhesive is completed in a static oven or a tunnel depending on the features of the adhesive. Vice versa, if adhesive conductive regions 35-37 are made by a solder paste, a reflow process is performed in standard conditions for lead-free solder pastes with a peak temperature of 260° C.

Therefore, if provided by the application, electronic components are bonded at each upper module; finally the composite boards obtained thereby are cut to obtain the single integrated switches 1.

The alignment in the plane of the boards is performed by optical positioning machines, which take the first board as a reference using references (designated "fiducials") made on the first board for metal plating, screening, marking, cutting, or boring. Thus, the effect of the sum of tolerances is avoided, thereby making the positioning tolerance independent of the number of stacked boards. In cases where the inductances are high enough and the number of overlaid boards is low, and thus the alignment error has a reduced influence on the overall inductance of the module, the superimposition may be performed by a support with metal plugs that pass through centering holes made on the boards. The supports are then used for baking in static or tunnel ovens of the stacked boards and then removed before cutting.

In an embodiment, core layer 15 can have a thickness in the range approximately between 60 and 110 μm, for example approximately 100 μm, first and fourth insulating layers 10, 20, of solder mask, can have a thickness of about 20 μm, second and third insulating layers 12 and 18, of prepreg, can have an overall thickness in the range approximately between 30 and 40 μm, and metal layers 11, 13, 17 and 19 can have a thickness of about 17 μm for an overall thickness of each module 2-5 generally variable approximately between 220 (in case of thin device) and 300 μm (in case of standard device).

FIGS. 8-13, 15 relate to a different embodiment of the present integrated inductor, wherein each module includes a single substrate (drilled to make the connections), on which a conductive track that forms a coil is made (for example by screening, dispensing, or printing).

Also in this case, the processing occurs typically at a board level, each board forming a plurality of substrates that, after being superimposed and glued, are cut in a final step, to obtain the single inductors. However, for the sake of simplicity, the manufacturing steps are disclosed at a single substrate level.

Figure 8:
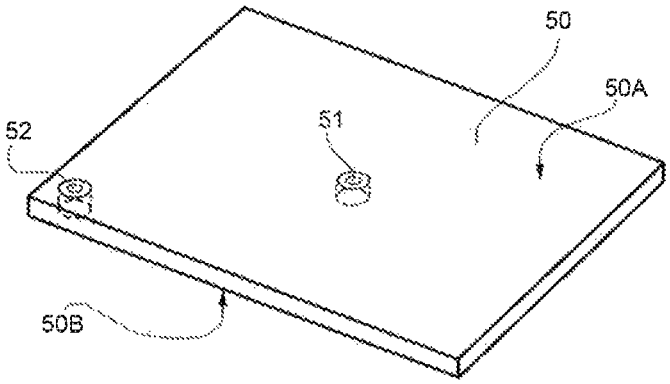
FIGS. 8 and 9 are perspective views in two subsequent manufacturing steps of a first substrate, usable in a different embodiment of the present integrated inductor.
Figure 13:
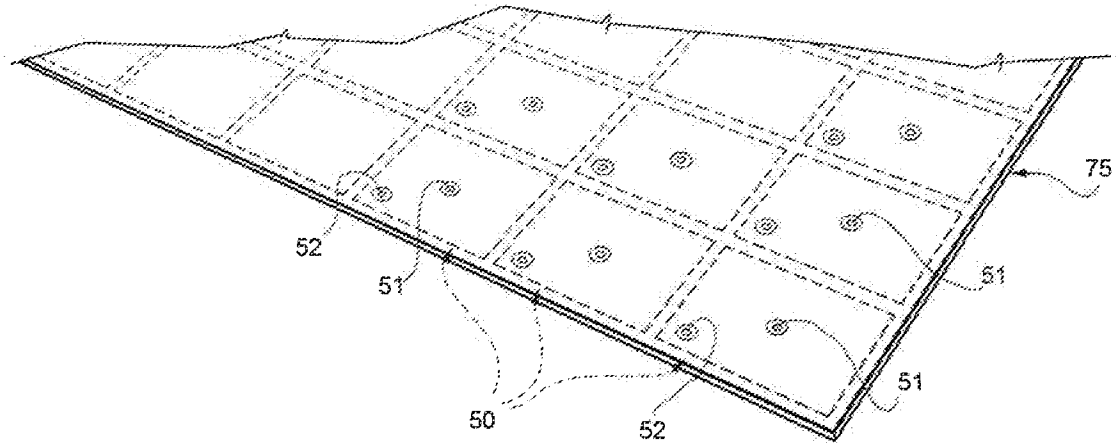
FIG. 13 shows a board integrating a plurality of substrates of the type shown in FIG. 8.

FIG. 8 shows a first substrate 50 provided with a first and a second surface 50A, 50B. As indicated above, the first substrate 50 may be one of a plurality of modules forming a board 75, as shown in FIG. 13.

The first substrate 50 can be of any insulating material such as BT (Bismaleidetriazine) or epoxy resin charged with glass fibers, injected plastic, PET, polycarbonate, or other types of plastic material, ceramics, glass, paper, cardboard, and the like. As an alternative, the first substrate 50 can be of a ferromagnetic material with the two opposite faces coated with a dielectric material layer as disclosed more in detail hereinafter. Furthermore, biocompatible or medical materials can be selected.

Initially, the first substrate 50 is drilled to form two through holes 51 and 52 extending between surfaces 50A, 50B. In FIG. 8, first through hole 51 is central and second through hole 52 is arranged near the edge of first substrate 50. Furthermore, in the example shown, through holes 51 and 52 are metallized. For a ferromagnetic substrate, the holes are at first coated with a dielectric layer, typically an epoxy or glass paste, for example by screening and then baking, and then filled with an adhesive conductive material or with a solder paste.

Figure 9:
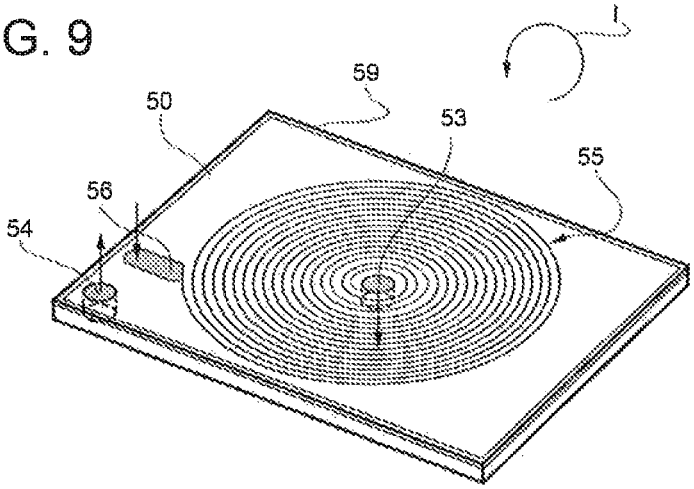
Figure 10:
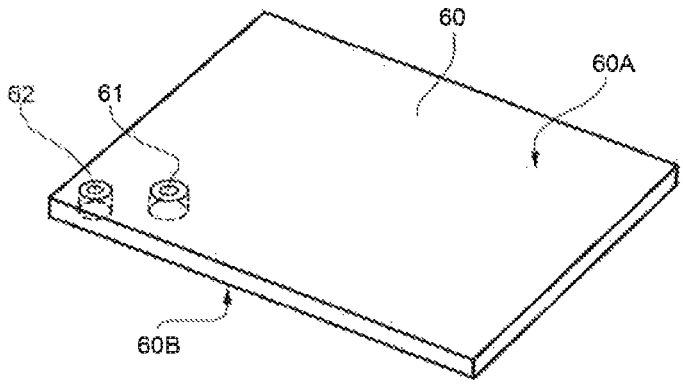
FIGS. 10 and 11 are perspective views in two subsequent manufacturing steps of a second substrate, usable with the substrate of FIGS. 8 and 9.

Hereinafter, in FIG. 9, a conductive material is printed or dispensed on first surface 50A of first substrate 50 so as to approximately simultaneously form a coil 55 and adhesive conductive regions forming both electric and mechanical connections. In an embodiment, a conductive glue or a solder paste is applied, for example by screening, on the upper surface of first substrate 50. The conductive material fills holes 51 and 52 (where it forms a first and a second via 53 and 54), forms a spiral (forming coil 55), a first contact region 56 and a peripheral region 59. Coil 55 extends between first via 53 (and therefore first through hole 51) and first contact region 56. First contact region 56 is made near the edge of first substrate 50, near but distinct from the second via 54 and the peripheral region 59 surrounds, for example completely, the first substrate 50.

Peripheral region 59 is similar to mechanical connection regions 37 of the embodiments of FIGS. 1-7 and has the aim of allowing the mechanical connection between first substrate 50 and a second overlaid substrate, as explained hereinafter.

The conductive material may be an adhesive material charged with conductive particles, or a lead-free solder paste formed by microparticles amalgamated with fluxes so as to obtain a pasty consistency, or a conductive ink. The adhesive materials are subjected to partial capture to control the extension thereof, thus avoiding short-circuiting between the coils and maintaining the adhesiveness thereof. For this purpose, spacers can be used. For example, when the inductance is dispensed, the spacers may be formed on the substrate, by previously dispensing adhesive cylinders of the same kind used for the manufacture of the inductance, or of a different kind, and by baking (for about an hour at a temperature of about 150° C.) so as to ensure a rigid support.

A second substrate 60 (shown in FIG. 10) is manufactured independently. Second substrate 60 is similar to first substrate 50, except for the position of the through-holes. Accordingly, the material of second substrate 60 may be any, possibly even another material with respect to first substrate 50, and second substrate 60 has first and second surfaces 60A, 60B.

In a processing step which occurs approximately simultaneously, before or after the processing steps of first substrate 50, second substrate 60 is drilled so as to form a third through hole 61 and a fourth through hole 62. Here, both through holes 61, 62 are formed near the edge of second substrate 60, with third through hole 61 in a position such as to be aligned, after the superimposition of substrates 50, 60, to first conductive region 56 of first substrate 50, and fourth through hole 62 aligned (after the superimposition of the substrates) to the second through hole 52. Also in this case, through holes 61, 62 can be metallized. Furthermore (not shown), second substrate 60 can be part of a respective board (not shown), similar to board 75 of FIG. 13.

Subsequently (FIG. 11), second substrate 60 is printed to form a respective coil 65, a second contact region 66, and an own peripheral region 59. This step is carried out as already disclosed for first substrate 50 by applying a conductive glue or a solder paste, and also leads to the filling of fourth and fifth hole 61, 62. Thereby, a third and fourth via 63 and 64 form in through holes 61, 62, and coil 65 extends between third via 63 and second contact region 66.

Even in this case, coil 65 of second substrate 60 is wound in an opposite direction with respect to coil 55 of first substrate 50. Indeed, in the embodiment which is shown, coil 55 of first substrate 50 extends counterclockwise from the outside (first connection region 56) inwards (first via 53), while coil 65 of second substrate 60 extends clockwise from the outside (third through via 63) inwards (third connection region 66), so that the current always flows in the same direction, as explained hereinafter.

Therefore, second substrate 60 is superimposed over first substrate 50, with surface 60B in contact with surface 50A, so that third via 63 is overlaid and electrically contacts first contact region 56 and fourth via 64 is overlaid and electrically contacts second via 54. Subsequently, another first substrate 50 is superimposed over second substrate 60 so that first via 53 is overlaid vertically to third connection region 66 and second via 54 is overlaid vertically to fourth via 64. Also in this case, the process of superimposition may be performed using fiducials (not shown), always referring each substrate 50, 60 added on top, to the bottom substrate.

Figure 12:
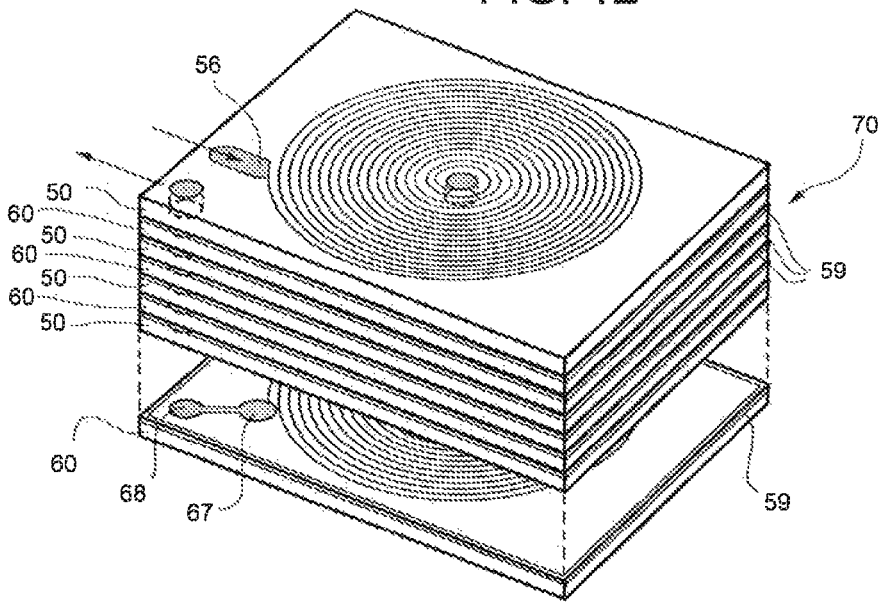
FIG. 12 shows an integrated inductor which can be obtained by alternately superimposing a plurality of substrates according to FIGS. 9 and 11.

The process continues with the alternated superimposition of first and second substrates 50, 60, to obtain an integrated inductor 70, shown in FIG. 12 and formed by a stack of substrates 50, 60, for example 10.

Figure 11:
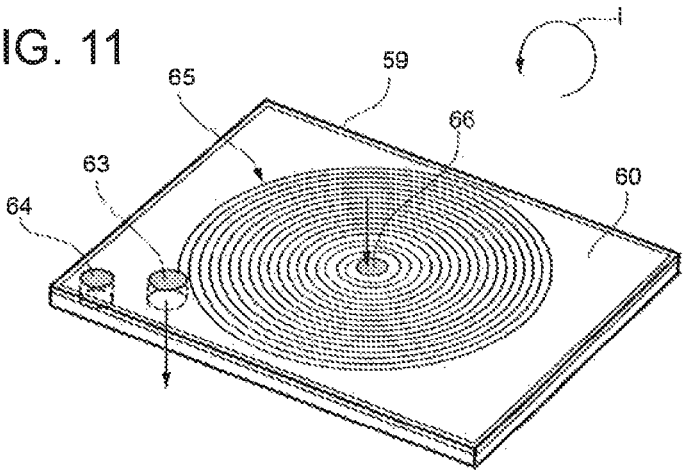

During superimposition, the bottom substrate of the stack, having the configuration of second substrate 60 of FIG. 11, may not be preventively drilled and have, instead of third and fourth vias 63, 64, corresponding contact regions 67, 68 (FIG. 12) coupled to one another. Furthermore, the top substrate in the stack has the configuration of first substrate 50 of FIG. 9, and may not have peripheral region 59. In this case, during the application of the conductive glue or solder paste, first connection region 56 and the top portion of third via 54 can be shaped so as to form connection pads for the outer connection.

Optionally, before being stacked, substrates 50 and 60 can be subjected to a heating step in an oven, so as to increase the consistency of the adhesive conductive regions, in particular of peripheral regions 59. For this purpose, the heating is performed at a temperature lower than the polymerization temperature, for example lower than about 100° C. for a time of about 10 minutes.

Finally, at the end of the alternated superimposition of substrates 50 and 60, these are reciprocally glued, arranging the stack of substrates 50, 60 in an oven at a temperature in the range approximately between 120-170° C., typically about 150° C., for about 1-2 hours, so as to obtain the polymerization of the conductive glue or solder paste and, therefore, the gluing of peripheral regions 59 of each substrate 50, 60 to the overlaying substrate 60, 50, as well as of first and second contact regions 56, 66 to the respective overlaying and underlying metallized vias 63, 53.

When substrates 50, 60 are each part of a respective board including a plurality of substrates 50 or 60, after gluing the stack is singulated to form single inductors 70.

Thereby, in the integrated inductor 70 of FIG. 12, in which first contact region 56 represents a current input and the end of second via 54 represents a current output, the current always flows in a counterclockwise direction, entering the first contact region 56 of upper substrate 50 and flowing through first coil 55 up to first via 53, which is in electrical contact with the second contact region 66 of second coil 65 (FIG. 11) of underlying substrate 60. Therefore the current also flows through second coil 65 in a counterclockwise direction up to third contact via 63 and from here reaches first contact region 56 of a first underlying substrate 50. After flowing through all the coils in a counterclockwise direction, the current reaches contact regions 66, 67 and then passes through second and fourth vias 54, 64, which are overlaid to one another, up to second via 54 of the overlaid substrate, which represents an output terminal of integrated inductor 70.

Figure 15:
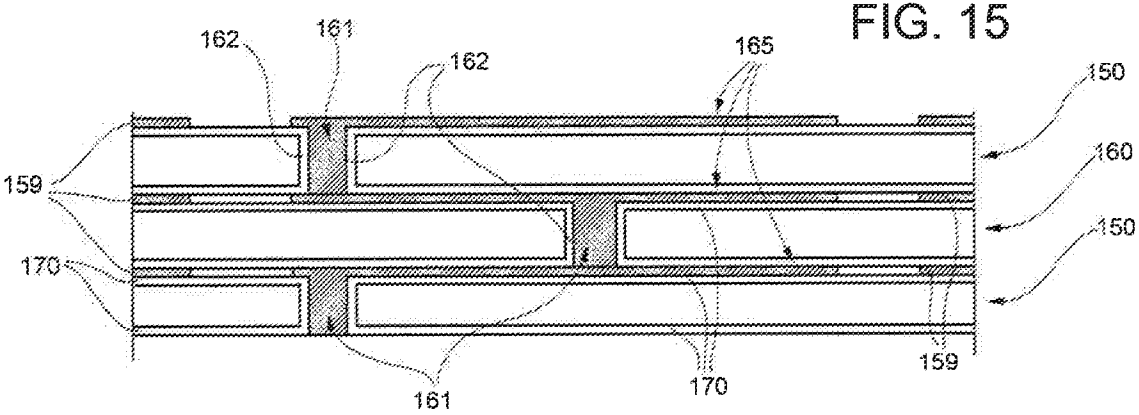
FIG. 15 shows the cross-section of a detail of a variant of the inductor of FIG. 12.

FIG. 15 shows a detail of a variant of the integrated inductor of FIG. 12, using substrates 150, 160 of a ferromagnetic material, covered by insulating layers 170 on the two faces. A coil 165 is formed on one of the faces (for example the top one) of substrates 150, 160. As already indicated, vias 161 (corresponding to vias 53-54, 63-64) are insulated from corresponding substrate 150, 160 by an insulation 162. Insulating layers 170 can be screened and peripheral regions 159 (made approximately simultaneously to coils 165 and to contact regions which are not shown and are similar to contact regions 56, 66) allow mutual gluing of substrates 150, 160. In this case, a further increase of the overall value of the inductance, as well as an increase in the mechanical resistance of the module, may be obtained.

Figure 14:
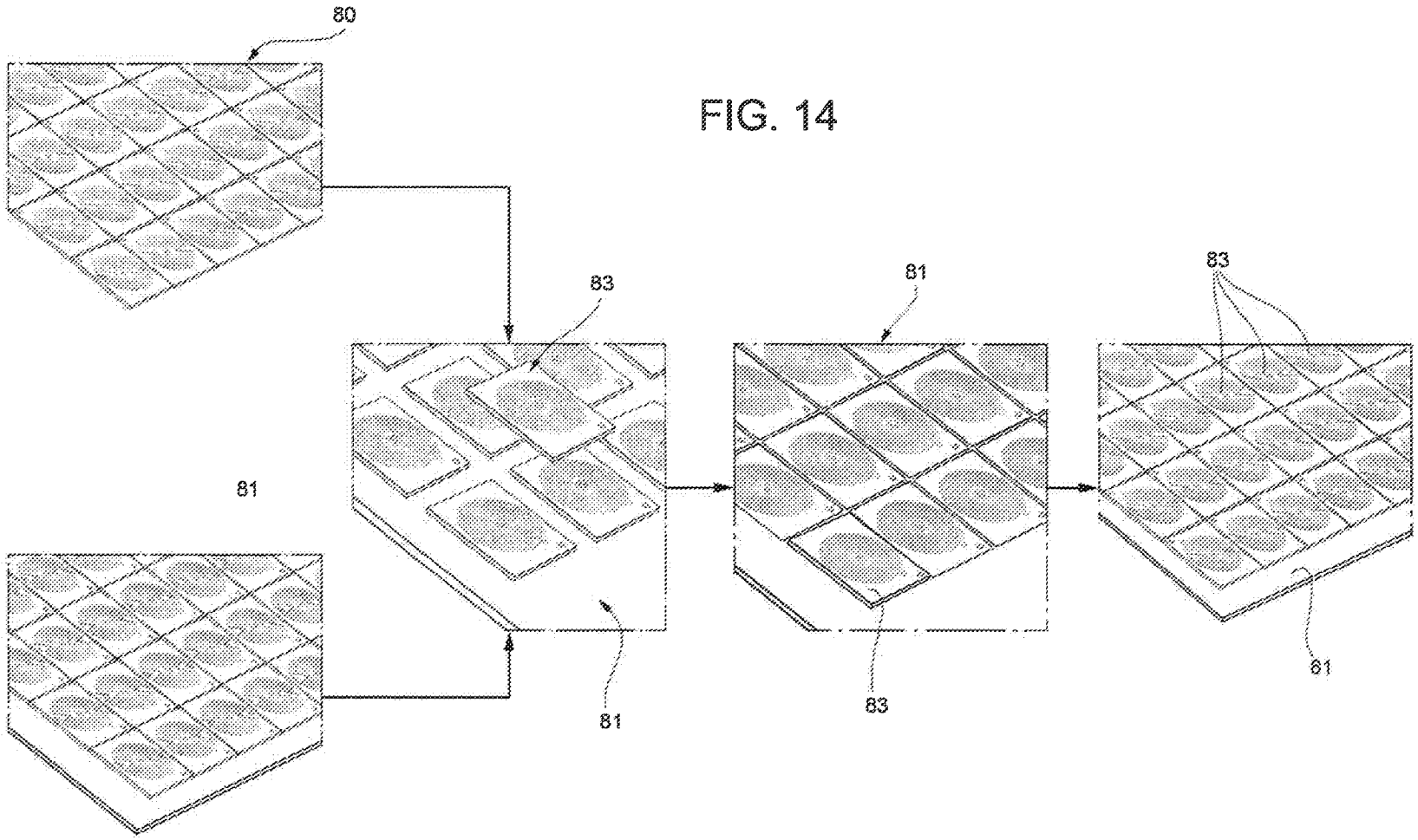
FIG. 14 shows subsequent manufacturing steps of integrated inductors, according to an embodiment.

FIG. 14 shows a different manufacturing process. In this case, a first board 80 and a second board 81 each integrating coils in an opposite direction are manufactured independently. Boards 80, 81 may be subjected to the same manufacturing steps disclosed above to obtain modules 2-5 of FIGS. 1-7, for example modules 2 and 5, or substrates 50, 60 of FIGS. 9 and 11. Therefore, according to the known technique of "pick and place", first panel 80 is cut, so as to form a plurality of single elements 83 which are singularly taken and arranged over corresponding elements of second board 81, on which (by dispensing or screening) a conductive adhesive or a solder paste has been preventively applied and which has been prebaked (in the case of conductive adhesive). After all single elements 83 have been arranged, these are glued to board 81, for example by polymerization of peripheral region 59.

Before gluing single elements 83, different boards can also be superimposed; or different modules 83 can be superimposed to each other on board 81.

An embodiment of the integrated inductor and an embodiment of the corresponding manufacturing process, as disclosed herein, have several advantages.

In particular, an embodiment of the present integrated inductor can be made of the desired value, even having a magnitude on the order of one pH, with a simple layout of the single layers and with limited manufacturing costs. The layers of the dielectric can be made thin, therefore helping the coupling effect among the various overlaid coils.

The manufacture of the substrates of ferromagnetic material insulated by dielectrics allows to further increase the value of the overall inductance of the module.

The adhesive conductive regions among different overlaid modules may be formed in the same manufacturing step and therefore may be of the same material and may be arranged on the same level (horizontal alignment). This provides a high mechanical and electrical resistance of the connections, as well as a simple manufacturing that requires limited costs.

An embodiment of FIGS. 8-13 is advantageously usable in case the substrate is made of a non-conventional material, such as glass or plastic, if there are particular requirements, such as light mechanical flexibility.

It is finally apparent that changes and variations can be made to the devices and manufacturing processes disclosed and shown herein without departing from the scope of the disclosure.

For example, as indicated, substrates 50, 60 of the embodiment of FIGS. 8-13 can be made of paper or cardboard. In this case the coils and the adhesive regions can be made of conductive ink, such as for example an ink made by charging an appropriate solvent with carbon or silver microparticles to an extent as to obtain a viscosity suitable for deposition by dispensing or screening.

The through holes 51, 52 and 61, 62 may also be preventively metallized when vias 53, 54, 63, 64, 161 are made.

In case both the input connection and the output connection are not to be on the same upper side of the integrated inductor, vias 33 or 54, 64 of the output connection of the current can be avoided.

The application of the conductive adhesive or of the solder paste in the through holes for forming the electrical connections through the substrates can take place approximately simultaneously to or before the manufacture of the inductance, and as a function of the ratio between the diameter of the hole and the thickness of the substrate ("aspect ratio").

The metal layers 11, 13, 17, 19 of the embodiment of FIGS. 1-7 can be replaced by conductive layers, for example layers of an organic compound.

Furthermore, contact regions 35, 36; 56, 66 can be formed by portions of respective coils 55, 65, 165, without being distinct therefrom.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

The invention claimed is:

1. An article, comprising:

a plurality of modules, each module comprising, a first conductive coil that has an outer end and an inner end and that spirals in a direction from the outer end to the inner end; and a second conductive coil that is disposed over the first coil, has an outer end and an inner end, and spirals in the direction from the inner end to the outer end, one of the outer and inner ends of the second coil electrically coupled to a respective one of the outer and inner ends of the first coil;

at least one first adhesive conductive region, each first adhesive conductive region being formed on an upper surface or a lower surface of the module to mechanically interconnect the module to at least one other module and being electrically isolated from the first and second conductive coils of the module; and at least one second adhesive conductive region formed on at least one of the upper and lower surfaces, each second adhesive conductive region being positioned to electrically interconnect the module to at least one other module.

2. The article of claim 1 wherein for each of the modules:

the first conductive coil is approximately planar; and the second conductive coil is approximately planar.

3. The article of claim 1 wherein for each of the modules:

the first conductive coil is approximately flat; and the second conductive coil is approximately flat.

4. The article of claim 1 wherein for each of the modules the inner end of the first coil is electrically coupled with the inner end of the second coil.

5. The article of claim 1 wherein for each of the modules the outer end of the first coil is electrically coupled with the outer end of the second coil.

6. The article of claim 1, wherein each of the modules further comprises:

a first insulator layer;

a second insulator layer disposed over the first insulator layer;

wherein the first coil is disposed over the first insulator layer; and wherein the second coil is disposed over the second insulator layer.

7. The article of claim 1, wherein each of the modules further comprises:

a first insulator layer having a side, an edge, and a conductor disposed on the side along the edge;

a second insulator layer disposed over, and having a side that faces away from, the side of the first insulator layer;

wherein the first coil is disposed over the side of the first insulator layer; and wherein the second coil is disposed over the side of the second insulator layer that faces away from the first insulator layer.

8. The article of claim 1 wherein each of the modules further comprises:

a first insulator layer having a side;

a second insulator layer disposed over, and having a side that faces toward, the side of the first insulator layer, having an edge, having an opposite side, and having a conductor disposed on the side along the edge;

wherein the first coil is disposed over the side of the first insulator layer; and wherein the second coil is disposed over the opposite side of the second insulator layer.

9. The article of claim 1 wherein each of the modules further comprises:

a first insulator layer;

a second insulator layer disposed over the first insulator layer;

wherein the first coil is disposed over the first insulator layer;

wherein the second coil is disposed over the second insulator layer;

a first current return disposed over the first insulator later;

a second current return disposed over the second insulator layer in alignment with the first current return; and a via that electrically couples the first and second current returns.

10. The article of claim 9, wherein each first adhesive conductive region comprises a peripheral region disposed on the upper or lower surface around the entire periphery of the module.

11. The article of claim 9, further comprising a third coil that is disposed over the second coil, has an outer end and an inner end, and spirals in the direction from the outer end to the inner end, one of the outer and inner ends of the third coil electrically coupled to the other one of the outer and inner ends of the second coil that is not coupled to the first coil.

12. The article of claim 1, wherein each of the at least one first and second adhesive conductive regions comprises one of an adhesive glue, a lead-free solder paste, a conductive ink, and an organic compound.

13. The article of claim 12, wherein the lead-free solder paste comprises one of a tin-silver and a tin-silver-copper solder paste.

14. The article of claim 1, wherein each of the plurality of modules comprises one of a ball grid array substrate and a land grid array substrate.

15. An article, comprising:

a plurality of modules, each module comprising, a first conductive coil that has an outer end and an inner end and that spirals in a direction from the outer end to the inner end; and a second conductive coil that is disposed over the first coil, has an outer end and an inner end, and spirals in the direction from the inner end to the outer end, one of the outer and inner ends of the second coil electrically coupled to a respective one of the outer and inner ends of the first coil;

at least one first adhesive conductive region, each first adhesive conductive region being formed on an upper surface or a lower surface of the module and the first adhesive conductive region extending around the module near edges defining a periphery of the module to mechanically interconnect the module to at least one other module, and each first adhesive conductive region being electrically isolated from the first and second conductive coils of the module; and at least one second adhesive conductive region formed on at least one of the upper and lower surfaces, each second adhesive conductive region being positioned to electrically interconnect the module to at least one other module.

16. The article of claim 15, wherein each of the at least one first and second adhesive conductive regions comprises one of an adhesive glue, a lead-free solder paste, a conductive ink, and an organic compound.

* * * * *